US005202062A

United States Patent [19]

Baba et al.

[11] Patent Number: 5,202,062

[45] Date of Patent: Apr. 13, 1993

[54] DISPOSAL METHOD OF RADIOACTIVE WASTES

[75] Inventors: Tsutomu Baba; Koichi Chino; Masami Matsuda; Takashi Nishi, all of Hitachi; Kiyomi Funabashi; Takashi Ikeda, both of Katsuta; Akira Sasahiro, Hitachi; Makoto Kikuchi, Hitachi; Shin Tamada, Hitachi, all of Japan

[73] Assignee: Hitachi Ltd., Tokyo, Japan

[21] Appl. No.: 660,997

[22] Filed: Feb. 26, 1991

[30] Foreign Application Priority Data

Mar. 2, 1990 [JP] Japan ..... 2-49274

[51] Int. Cl.[5] ..... G21F 9/12

[52] U.S. Cl. ..... 252/633; 252/626; 210/751; 210/754; 210/757; 423/17; 423/166; 423/186; 423/189; 423/190

[58] Field of Search ..... 252/626, 633; 210/751, 210/754, 757; 423/17, 166, 186, 189, 190, DIG. 20

[56] References Cited

U.S. PATENT DOCUMENTS

| | | | |
|---|---|---|---|
| 3,962,080 | 6/1976 | Dulin et al. | 210/751 |
| 4,361,505 | 11/1982 | Kikuchi et al. | 252/628 |
| 4,581,162 | 4/1986 | Kawamura et al. | 252/628 |
| 4,671,897 | 6/1987 | Mori et al. | 252/628 |
| 4,775,495 | 10/1988 | Izumida et al. | 252/628 |
| 4,804,498 | 2/1989 | Mizumo et al. | 252/628 |

*Primary Examiner*—Brooks H. Hunt
*Assistant Examiner*—Ngoclan T. Mai
*Attorney, Agent, or Firm*—Evenson, Wands, Edwards, Lenahan & McKeown

[57] ABSTRACT

The present invention adds carbonates or chlorides of alkaline earth metals to the radioactive wastes containing sodium sulfate and subjects sulfate group in the radioactive wastes to reduction treatment, thereby converts the sulfate group into sulfides of alkaline earth metals which are chemically stable substances while suppressing SOx generation, and solidifies the radioactive wastes stably for an extended period of time by applying to the converted radioactive wastes solidifying treatment.

12 Claims, 4 Drawing Sheets

DISPOSAL METHOD OF RADIOACTIVE WASTES

BACKGROUND OF THE INVENTION

The present invention relates to a disposal method of radioactive wastes containing sulfate group ($SO_4^{2-}$) and a device therefor, in particular, relates to a disposal method of radioactive wastes and a device therefor suitable for solidifying the radioactive wastes in a container by a solidifier such as cement.

In plants such as a nuclear power plant handling radioactive materials, radioactive wastes such as radioactive liquid waste and used-up ion-exchanger resin are produced. Conventionally, these radioactive wastes were, for example, after drying treatment, solidified in a container by a solidifier consisting of such as cement, asphalt, or plastics.

In these days, a disposal method was proposed in which such as liquid waste containing sodium sulfate among these radioactive wastes was subjected to heating and melting treatment by adding such as silicon dioxide in the presence of a reducer and solidified to solid glass wastes containing radioactive materials (JP-A-61-79200 (1986), for example). According to this disposal method, since sulfate group which is an active portion of the sodium sulfate is converted to a stable chemical state, the method has an advantage that a stable solidified body can be formed. In addition to the above patent publication, the disposal method of this kind is disclosed such as in JP-A-60-159699 (1985), JP-A-61-79199 (1986), JP-A-61-82199 (1986), JP-A-59-108995 (1984) and JP-A-63-171399 (1988).

In the above conventional art, sulfur oxides (SOx) are generated when the radioactive wastes are vitrified with the heating and melting treatment. The emission of SOx into an environment is not preferable from a viewpoint of such as acid rain. When SOx is collected for suppressing the emission to the environment, the collected SOx is finally converted into sulfate group, and which may necessitate to be treated again as radioactive wastes.

SUMMARY OF THE INVENTION

An object of the present invention is to provide a disposal method of radioactive wastes and a device therefor which enables to treat to convert sulfate anion contained in the radioactive wastes (liquid waste such as sodium sulfate) to another substance in a stable chemical state while suppressing generation of SOx.

For achieving the above object, the present invention adds carbonates or chlorides of alkaline earth metals to the radioactive wastes containing sodium sulfate and treats to reduce sulfate group in the radioactive wastes (namely, during the reduction treatment of sulfate group in the radioactive wastes containing sodium sulfate, the reduction treatment of sulfate group in the radioactive wastes is conducted so that sulfides of alkaline earth metals are produced).

Calcium carbonate, magnesium carbonate and barium carbonate are used as carbonates of alkaline earth metals, however calcium carbonate is desirable from a viewpoint of such as economy. Calcium chloride, magnesium chloride and barium chloride are used as chlorides of alkaline earth metals. When comparing the carbonates and the chlorides, the carbonates are preferable if assumed such an instance that the materials produced during the reaction treatment mix into reused water in a nuclear power plant.

In the above reduction treatments the carbon reduction treatment is preferably from a viewpoint of such as safety and treatment operability.

As an application example of the present invention, such treatment method is conceivable that sulfides of alkaline earth metals produced by the above reduction treatment are decomposed into carbonates of alkaline earth metals and hydrogen sulfide and subsequently the hydrogen sulfide is separated into sulfur and water through oxidation treatment to be finally recovered.

Further, the radioactive wastes are stored stably for an extended period of time by solidifying the reaction product produced by the above treatment in a container by a solidifier such as cement.

The device for implementing the method of the present invention is constituted by means for accommodating the radioactive wastes containing sodium sulfate, means for accommodating carbonates of alkaline earth metals, means for accommodating a reducer for sulfate group, and a reaction container for receiving the radioactive wastes, carbonates and reducer from these accommodating means and causing reaction thereof through heating.

Further, the disposal device for. the radioactive wastes is constituted by adding further means for accommodating the reaction product from the above reaction container in a final disposal use container and solidifying thereof by a solidifier.

Nextly, the principle of the present invention is explained by taking as an example of a case where the radioactive wastes are reduced by adding calcium carbide in the presence of a carbon reducer.

By adding calcium carbonate and carbon as the reducer for sulfate group to the radioactive wastes containing sodium sulfate and heating the mixture until at least to a temperature (for example, more than 650° C.) at which the mixture begins to form solid solution, the following reaction proceeds.

$$Na_2SO_4 \xrightarrow{C,\ CaCO_3} Na_2CO_3 + CaS + CO_2\uparrow \quad (1)$$

The sulfate group is converted to other stable substances via this reaction. Namely, such reaction products which produce by-products such as ettringite by reacting, for example, with cement component used as the solidifier are eliminated. Particularly, CaS, a sulfide is an insoluble substance, and can be solidified stably for an extended period of time in a solidifier when it has been solidified by the solidifier. Further, the generation of SOx is suppressed in this reaction.

From the above reaction formula, it is understood that substances for producing a stable sulfide be added which reacts with sulfur during the reduction treatment. The inventors of the present invention found out that carbonates or chlorides of alkaline earth metals such as calcium, magnesium and barium is suitable for the substances therefor.

With CaS produced in the above reaction the following reaction is further induced by action of water and carbon dioxide.

$$CaS \xrightarrow{CO_2,\ H_2O} CaCO_3 + H_2S\uparrow \quad (2)$$

$H_2S$ can easily be decomposed to sulfur (S) and water ($H_2O$) by oxidation treatment with such as $Fe_2O_2$ and the decompositions are easily recovered. Since the sulfur is not accompanied by radioactive nuclides, it may be used for industrial use raw materials. The resultant water may be reused for the treatment of CaS. Further, $CaCO_3$ may be used for the initial reduction treatment. In this instance, $Na_2CO_3$ produced by the initial reduction treatment can be solidified by a solidifier.

BRIEF DESCRIPTION OF THE DRAWINGS

Further objects, features and advantages of the present invention will become more clear from the following detailed description of a preferred embodiment, shown in the accompanying drawings, wherein.

DETAILED DESCRIPTION OF PREFERRED EMBODIMENTS

Figure 1:
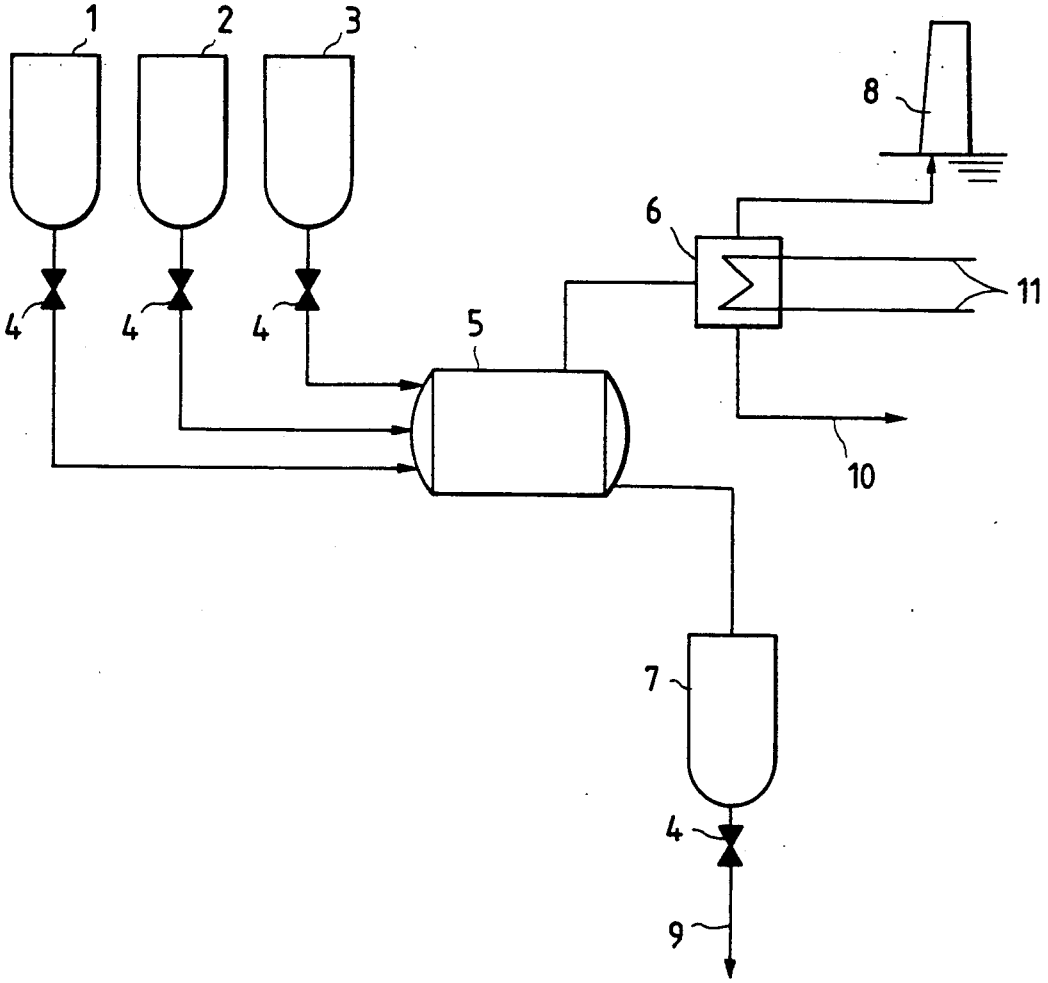
FIG. 1 is a conceptual diagram of a device for implementing a process for converting surfate group into sulfides according to the present invention.

Hereinbelow, one embodiment of the present invention is explained with reference to FIG. 1. Enriched, or concentrated liquid waste (major component is $Na_2SO_4$) discharged from a boiling water type nuclear reactor power plant (BWR power plant) is stored in a liquid waste storage tank 1. The enriched liquid waste is led from the tank 1 through a valve 4 to a reaction vessel 5. On the other hand, calcium carbonate is led from a carbonate supply tank 2 through a valve 4, and carbon powder which is a reducer from a carbon supply tank 3 through a valve 4 to the reaction vessel 5, respectively. The reaction vessel has a high temperature and high pressure resistant structure, and is made of a material such as stainless steel and titanium alloys which can withstand against a high temperature water solution reaction.

The liquid waste in the enriched liquid waste storage tank 1 is time to time measured by such as a conductivity meter (not shown in the drawing) of the content of $Na_2SO_4$. Respective inflow amounts from the carbonate supply tank 2 and the carbon supply tank 3 are selected of an sufficient amount through which sulfate group in the liquid waste are reduced and further calcium sulfide is formed in accordance with the amount of the liquid waste led to the reaction vessel.

For example, to 10 kg liquid waste including 30 wt % of $Na_2SO_4$ when 5.5 kg calcium carbonate and 1 kg carbon powder are mixed, the sulfate radicals in the liquid waste is substantially converted into calcium sulfide.

The reaction vessel 5 is provided with a heating means such that the inflowed materials can be heated upto a temperature enough for the reaction.

A heating temperature more than the temperature at which the inflowed materials begin to form solid solution is satisfactory, but the heating temperature is preferably controlled to be less than the temperature at which sodium sulfate does not decompose In the present embodiment, the heat treatment in a range of about 500°–800° C. is desirable. The chemical reaction of the above formula (1) is proceeded through the reaction in the reaction vessel 5 at a temperature more than 500° C. for about one hour.

By this reaction, $Na_2SO_4$ is converted to produce solid substances $Na_2CO_3$ and CaS. Among these solid substances, since CaS, a sulfide, is a stable chemical substance and insoluble in water, such that when solidification treatment thereof is conducted the radioactive wastes can be solidified stably for an extended period of time. Further, $Na_2CO_3$ is a soluble substance in water, but does not produce by-products through reaction with a solidifier component unlike the sulfate group, such that no deterioration of the solidified body is induced.

The waste materials containing solid substances which are the reaction products are collected from the reaction vessel 5 to a treated wastes storage tank 7, subsequently are sent through a valve 4 to a solidification treatment system line 9, and are treated as a solidified body.

In the above explanation, although the treatment in the reaction vessel 5 is performed at the atmospheric pressure, however when the reaction is proceeded by maintaining the reaction vessel at a high pressure (more than the atmospheric pressure), the reactions of the above (1) and (2) proceed, and the following reaction is effected as a total reaction.

$$Na_2SO_4 \xrightarrow[H_2O]{C,\ CaCO_3} Na_2CO_3 + CaCO_3 + CO_2\uparrow \quad (3)$$

In this reaction under a high temperature and high pressure and after the reaction of about one hour, $Na_2SO_4$ is converted to produce solid substances $Na_2CO_3$ and $CaCO_3$. The liquid waste containing these solid substances are collected in the treated waste material storage tank 7 like the above embodiment, and are subsequently sent through the valve 4 to the solidification treatment system line 9 and are treated as a solidified body.

On the other hand, $CO_2$ is generated from the reaction vessel 5 in the atmospheric pressure reaction, and $CO_2$ and $H_2S$ in the high temperature and high pressure reaction respectively. When $H_2S$ is generated, the gas from the reaction vessel is caused to be led to a fluidized bed using $Fe_2O_3$ particles (not shown in the drawing), and $H_2S$ is treated to be oxidized by contacting with air on the surface of $Fe_2O_3$ and to be converted to simple sulfur and water. Scattering of radioactive nuclides can be prevented by gradual release of the generated gas by the chemical change from the reaction vessel. Actually $CO_2$ and $H_2S$ are not accompanied by radioactive nuclides. Therefore, the separated simple sulfur (S) can be reused as industrial raw materials and sulfur cement. Further the sulfur can be treated as common waste materials by converting into sulfate compounds. Thereafter, $CO_2$ gas and steam are led to a condenser 6 through which cooling water 11 passes to be separated into gas and liquid. The liquid component is highly pure water, and is reused through a water waste treatment system line 10, or is released out of the system. The gas is highly pure (more than 30%) $CO_2$ offgas, and may be utilized as $CO_2$ source such as for the reaction in the above (2) or the gas is released through an offgas treatment system from a stack 8 to the air.

In the above embodiment the enriched (concentrated) liquid waste was directly led to the reaction vessel, however the process can be applied when the enriched (concentrated) liquid waste is dried and pulverized. In a nuclear power plant, the enriched liquid waste is sometimes dried and pulverized, and is stored in a form of $Na_2SO_4$ solid substance. In this instance, after restoring the solid substance to water solution, the conversion of sulfate group may be conducted according to the above embodiment, however after treating the solid substances as it is together with carbon powder and $CaCO_3$ powder by using a kiln at a temperature more than about 500° C. for 2-3 hours a solidification treatment may be performed. In this instance, the reaction as indicated in the formula (1) proceeds, and the chemical reaction terminates after the generation of $CO_2$ and the production of $Na_2CO_3$ and CaS. When solidifying these by inorganic solidifiers such as cement, sound inorganic solidified materials are produced.

Figure 2:
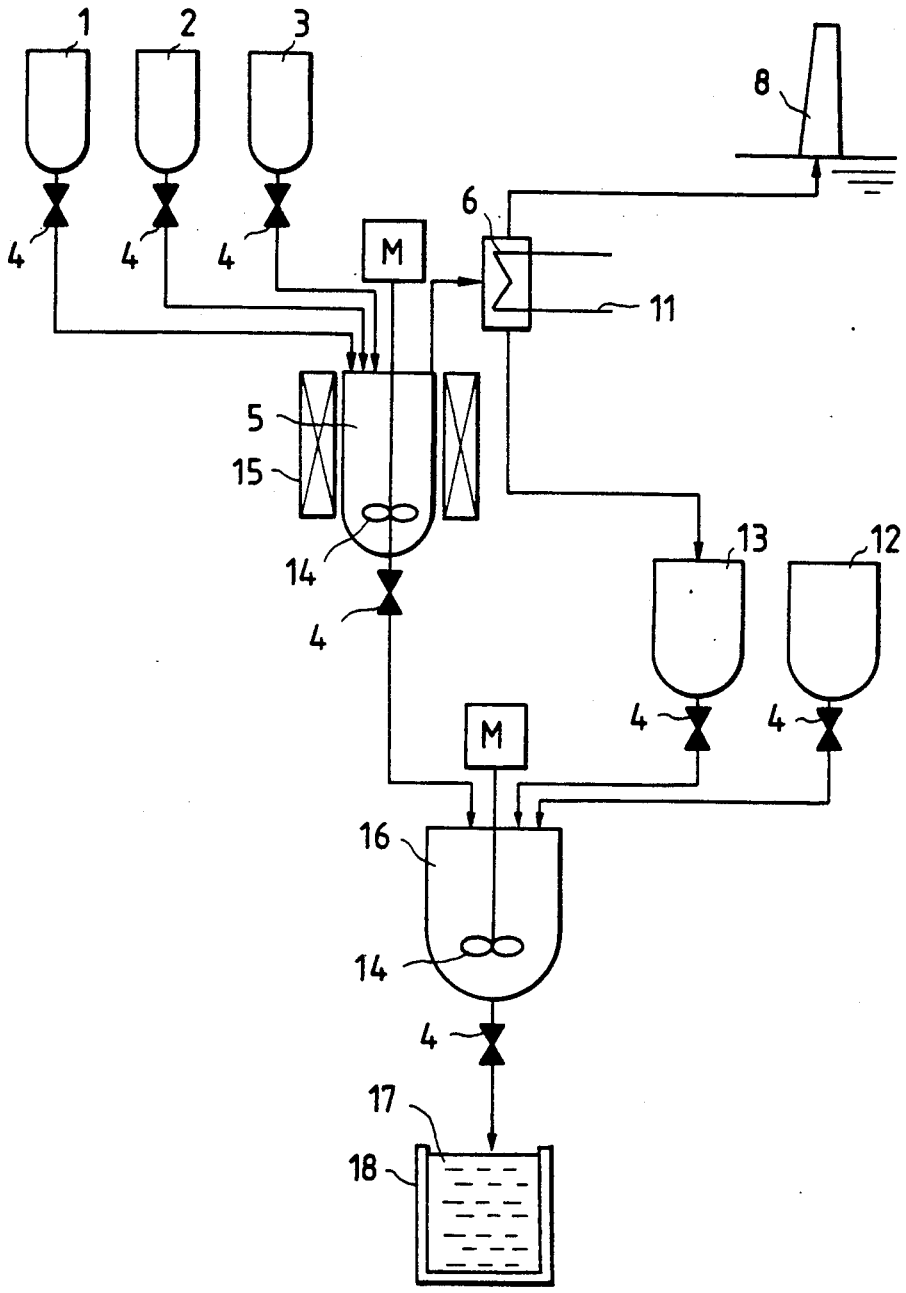
FIG. 2 is a conceptual diagram of a device in which the device shown in FIG. 1 is applied for uniform solidification of radioactive wastes.

Nextly, a flow leading to the solidification is explained with reference to FIG. 2. Enriched (concentrated) liquid waste (major component is $Na_2SO_4$) discharged from a BWR power plant is stored in a liquid waste storage tank 1, and is led from the tank through a valve 4 to a reaction vessel 5. On the other hand, calcium carbonate is led from a salt supply tank 2 through a valve 4, carbon powder from a carbon supply tank 3 through a valve 4, respectively to the reaction vessel 5. The reaction vessel 5 has a pressure resistance structure. Further, the reaction vessel 5 is provided with rotary blades 14 for stirring and a heater 15 so as to control reactions. Here, sodium sulfate reacts as in the method described in the above embodiment to produce treated wastes in which sulfate group has been converted into sulfides of alkaline earth metals. The gas generated during the conversion of the sulfate group is led, after passing through such as an alkaline scrabbler, to a condenser 6 through which cooling water 11 passes, and is separated into water component and gas component. The gas component is released through an offgas treatment system to the air from a stack 8. Since the condensed water is sufficiently clean, and is reused as it is. In FIG. 2 the condensed water is to be returned to a water tank 13 in the solidification system. When not being reused, it is possible to discharge the water out of the system through a water waste treatment system which employs such as a membrane permeation and an ion exchanger resin.

The treated wastes are led through a valve 4 to a kneading vessel 16. The kneading vessel 16 is provided with rotary blades 14 necessary for stirring and enables to stir homogeneously the wastes and solidifier. To the kneading vessel 16, simultaneously with the introduction of the treated wastes, solidifier is led from a solidifier tank 12 through a valve 4 and kneading water from the water tank 13 through a valve 4, respectively. When much water is contained in the treated wastes and the amount of kneading water is sufficient, supply from the water tank 13 is adjusted to a small amount. After satisfactorily homogeneous kneading the wastes and the solidifier, the kneaded is led to a solidification container 18 through a valve 4 below the kneading vessel 16, and is solidified and cured.

Here, although the flow diagram concerns with inorganic solidifiers represented by cement in mind as solidifiers to be used, in addition to the cement, cement glass, glass, plastics or asphalt may be used. Further, the kneading vessel 16 can be omitted and by introducing rotary blades directly into the solidification container 18 for kneading, so called in-drum method may be employed. The solidified bodies thus produced showed enough strength for the final disposal such as land disposal. In the present embodiment, the treated wastes which are discharged from the reaction vessel 5 can be solidified by a simple water content adjustment.

Figure 3:
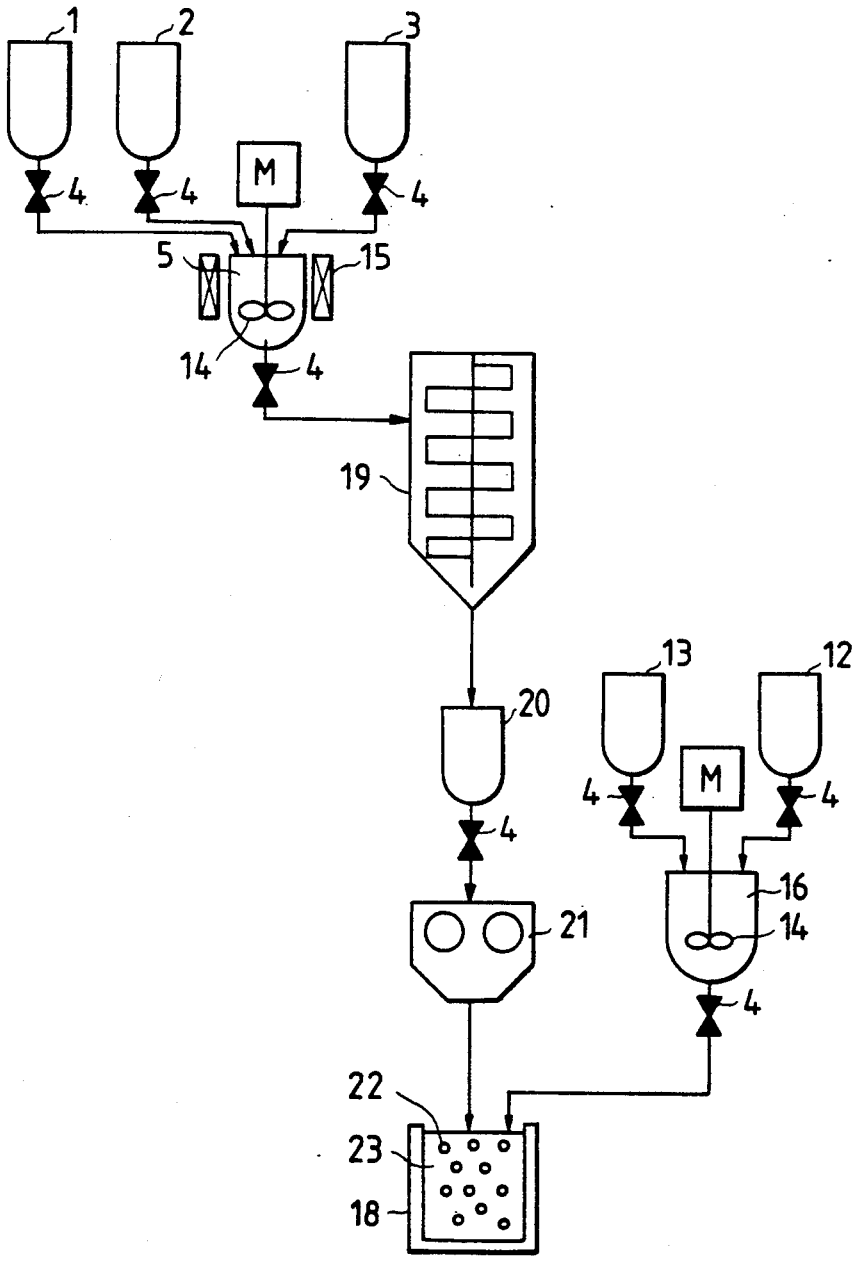
FIG. 3 is a conceptual diagram of a device in which the device shown in FIG. 1 is applied for pelletized solidification of radioactive wastes.

Nextly, a flow leading to pellet solidification according to the present invention is explained with reference to FIG. 3. Here, only a main system leading to the solidification is explained and explanation on the gas treatment system is omitted. The gas treatment system is to be conducted according to the method described in the above embodiment.

Enriched, or concentrated liquid waste discharged from a BWR power plant (major component is $Na_2CO_3$) is stored in a liquid waste storage tank 1, and is led from the tank through a valve 4 to a reaction vessel 5. On the other hand, calcium carbonate is led from a salt supply tank 2 through a valve 4 to the reaction vessel 5 and carbon powder from a carbon supply tank 3 through a valve 4, respectively. The reaction vessel 5 has a pressure resistant structure. Further, the reaction vessel 5 is provided with rotary blades 14 for stirring and a heater 15 enabling control of the reaction timely. Here, sodium sulfate is treated according to the process described in the above embodiment to produce treated wastes in which sulfate group has been converted. The by-produced gas in accompany with the conversion of sulfate group is properly treated such as by an alkaline scrabber. In the case of reaction generating $H_2S$, simple sulfur is separated through oxidization treatment according to the above described method.

The treated wastes are led from the reaction vessel 5 through a valve 4 to a rotary blade type thin film drier 19, and are pulverized (in the case of atmospheric pressure reaction, since the treated wastes are produced in solid state (lump state), these are to be pulverized in a crusher in place of the thin film drier). Thereafter, the pulverized is collected in a powder storage tank 20. The treated wastes in solid state are sent from the powder storage tank 20 through a valve 4 to a pelletizer 21, and are formed there into pellets 22. After forming into pellets, they are led to a solidification container 18 to subject to a solidification treatment. Materials previously kneaded are suitable for the solidifier which is used for the pellet solidification. Nextly, solidifier system is explained. Solidifier such as cement is led from a solidifier tank 12 through a valve 4 to a kneading vessel 16. On the other hand, kneading water is led from a water tank 13 through a valve 4 to the kneading vessel 16. The kneading vessel 16 is provided with rotary blades 14 rotated by a motor for kneading the solidifier homogeneously. The sufficiently kneaded solidifier is charged through a valve 4 into the solidification container 18 which is filled up beforehand with the pellets 22. Hardening is completed for about one week after charging to produce hardened solidifiers 23.

Inorganic solidifiers such as cement, cement glass and glass, or organic solidifiers such as plastics and asphalt are suitable for the solidifiers which are to be used here. The solidified body solidified by cement after pelletizing showed satisfactory characteristics for the final disposal use.

Figure 4:
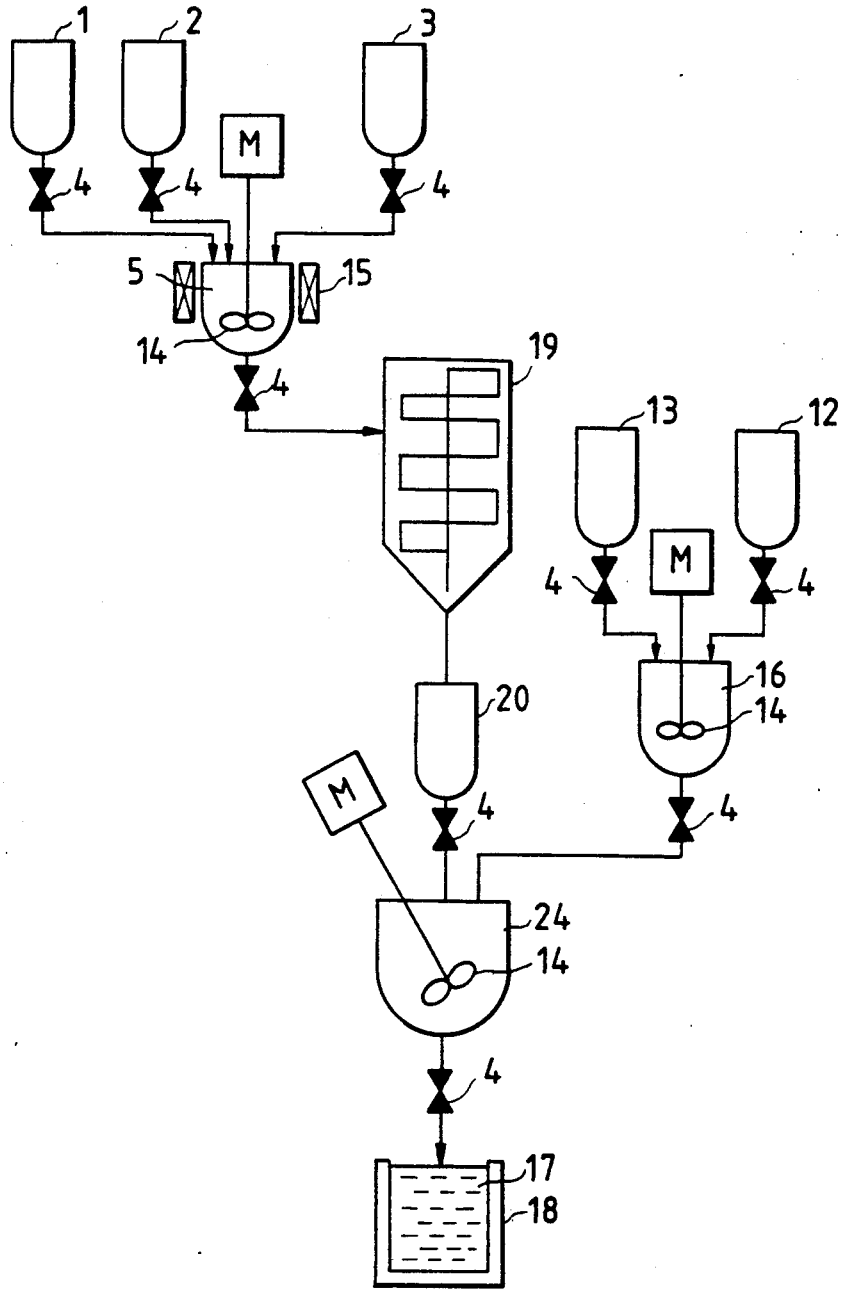
FIG. 4 is a conceptual diagram of another device in which the device shown in FIG. 1 is applied for uniform solidification of radioactive wastes.

Nextly, a flow leading to pulverization followed by solidification of the pulverized as it is after treating the wastes according to the present invention is explained with reference to FIG. 4. Here again like in the above embodiment for the pelletization, only the main system leading to solidification is explained and the explanation for the gas treatment system is omitted. The gas treatment system is operated in such method as explained in the above embodiment. Enriched (concentrated) liquid waste (major component is $Na_2SO_4$) discharged from a BWR power plant is stored in a liquid waste storage tank 1, and is led from the tank through a valve 4 to a reaction vessel 5. On the other hand, calcium carbonate is led from a salt supply tank 2 through a valve 4 to the reaction vessel 5 and carbon powder from a carbon supply tank 3 through a valve 4, respectively. The reaction vessel 5 has a pressure resistant structure. Further the reaction vessel 5 is provided with rotary blades 14 for stirring and a heater 15, and is adapted to control the reaction timely. Here sodium sulfate is treated according to the process described in the above embodiment to produce the treated wastes in which sulfate group has been converted into sulfides of alkaline earth metals. The gas by-produced in accompany with the conversion of sulfate group is treated properly such as by alkaline scrabbler. In a reaction in which $H_2S$ is generated, sulfur is separated and recovered in single elements or recovered in the form of sulfuric acid.

The treated wastes are led from the reaction vessel 5 through a valve 4 to a rotary blade type thin film drier 19, and are pulverized, thereafter the pulverized is collected in a powder storage tank 20. The treated wastes in solid state are led from the powder storage tank 20 through a valve 4 to a stirring vessel 24. On the other hand, solidifier is led from a solidifier tank 12 through a valve 4 to a kneading vessel 16, and herein is thoroughly mixed with kneading water which is led from a water tank 13 through a valve 4. The kneading vessel 16 is provided with a rotary blades 14 rotated by a motor for stirring to knead the solidifier homogeneously. Thereafter the solidifier is led to the stirring vessel 24 and mixed with the wastes. The stirring vessel 24 is provided with a rotary blades 14 rotated by a motor, and there the wastes and the solidifier are homogeneously kneaded. Thereafter the kneaded are led through a valve 4 to a solidification container 18. Homogeneous solidified bodies 17 are produced after curing for about one week.

The homogeneous solidified bodies produced according to the present invention showed equal or higher soundness to water in comparison with the conventional solidified bodies. Inorganic solidifiers such as cement glass and glass other than cement, and organic solidifiers such as plastics and asphalt are suitable for the solidifiers to be used here. Further, the waste materials, the solidifier and the kneading water may be introduced simultaneously into the stirring vessel 24, and at this time the kneading vessel 16 can be omitted.

According to the present invention, since a solidification treatment can be conducted after sulfate group ($SO_4^{2-}$) in sodium sulfate ($Na_2SO_4$) has been converted to other stable chemical forms, the wastes can be stably solidified for an extended period of time.

Further, solidifiers which cannot be used when sulfate group exists can be used. Namely all kinds of solidifiers can be used and the solidified bodies thus produced are much sound.

Still further, since sulfur in sulfate group is not released in the form of SOx during the reaction, influences to the environment can be eliminated.

While preferred embodiments along with variations and modifications have been set forth for disclosing the best mode and important details, further embodiments, variations and modifications are contemplated according to the broader aspects of the present invention, all as set forth in the spirit and scope of the following claims.

We claim:

1. A disposal method of radioactive wastes containing sodium sulfate, comprising the steps of adding an alkaline earth metal compound to the wastes;

reducing sulfate groups in the radioactive wastes so as to produce sulfide of alkaline earth metal present in the alkaline earth metal compound; and solidifying the sulfide of alkaline earth metal produced by said reduction step.

2. A disposal method of radioactive wastes according to claim 1 further comprising the steps of, decomposing the sulfide of alkaline earth metal produced by said reduction step into alkaline earth metal compound and hydrogen sulfide; and separating said hydrogen sulfide into sulfur and water by oxidation treatment and recovering the same.

3. A disposal method of radioactive wastes according to claim 1, wherein said solidifying step is performed by solidifying the sulfide of alkaline earth metal in a container with solidifier.

4. The disposal method of radioactive wastes according to claim 1, wherein the alkaline earth metal compound is carbonate of alkaline earth metal.

5. A disposal method of radioactive wastes according to claim 4, wherein said reduction step is carbon reduction treatment.

6. A disposal method of radioactive wastes according to claim 4, wherein said solidifying step is performed by solidifying the sulfide of alkaline earth metal in a container with solidifier.

7. The disposal method of radioactive wastes according to claim 1, wherein the alkaline earth metal compound is chloride of alkaline earth metal.

8. A disposal method of radioactive wastes according to claim 7, wherein said reduction step is carbon reduction treatment.

9. A disposal method of radioactive wastes according to claim 7, wherein said solidifying step is performed by solidifying the sulfide of alkaline earth metal in a container with solidifier.

10. The disposal method of radioactive wastes according to claim 2, wherein the alkaline earth metal compound is carbonate of alkaline earth metal.

11. The disposal method of radioactive wastes according to claim 1, wherein alkaline earth metal compound is carbonate of alkaline earth metal and wherein the reducing step comprises:

first adding carbon to the radioactive wastes generated from a boiling reactor type nuclear power plant; and then heat-treating the mixture of said radioactive wastes, said carbonate of alkaline earth metal and said carbon at a temperature of 500°-800° C.

12. A disposal method of radioactive wastes according to claim 11 further comprising the step of solidifying the reaction product produced by said heat treatment in a container with solidifier.

* * * * *